US005171136A

United States Patent [19]

Pacht

[11] Patent Number: 5,171,136

[45] Date of Patent: Dec. 15, 1992

[54] FLUID FLOW CONTROL DEVICE

[75] Inventor: Amos Pacht, Houston, Tex.

[73] Assignee: Butterworth Jetting Systems, Inc., Houston, Tex.

[21] Appl. No.: 647,744

[22] Filed: Jan. 28, 1991

[51] Int. Cl.[5] ..... F04B 21/02

[52] U.S. Cl. ..... 417/571; 417/539; 137/541; 137/454.4

[58] Field of Search ..... 417/570, 571, 521, 539; 137/454.4, 541

[56] References Cited

U.S. PATENT DOCUMENTS

| | | | |
|---|---|---|---|
| 1,260,663 | 3/1918 | Mossholder | 137/541 |
| 3,372,648 | 3/1968 | Hammelmann . | |
| 3,542,057 | 11/1970 | Staiano | 137/541 |
| 3,679,332 | 7/1972 | Yohpe | 417/570 |
| 3,727,636 | 4/1973 | Simmons | 137/541 |
| 3,820,922 | 6/1974 | Buse et al. | 417/454 |
| 3,831,845 | 8/1974 | Pacht | 239/76 |
| 4,141,676 | 2/1979 | Jannen et al. | 417/539 |
| 4,277,229 | 7/1981 | Pacht | 417/454 |
| 4,768,933 | 9/1988 | Stackowiak | 417/570 |
| 4,878,815 | 11/1989 | Stachowiak | 417/539 |

*Primary Examiner*—Michael Koczo
*Assistant Examiner*—Charles G. Freay
*Attorney, Agent, or Firm*—Jones, Day, Reavis & Pogue

[57] ABSTRACT

A novel pressurized fluid delivery system which has a single fluid inlet block for each plunger of a pump assembly and with an individual fluid inlet manifold and an individual fluid discharge manifold coupled by a valve body assembly to the fluid cylinder block. The three individual units, the fluid inlet manifold, the fluid outlet or discharge manifold, and the fluid cylinder block, are small in size and weight when compared to the single large fluid cylinder block of the prior art and thus are much less expensive to manufacture and are easier to handle. The novel valve assembly is less expensive to manufacture, has a lower restriction to fluid flow than prior art comparable valves and requires less suction feed pressure than the prior art valves.

3 Claims, 2 Drawing Sheets

FLUID FLOW CONTROL DEVICE

FIELD OF THE INVENTION

The present invention relates in general to a pressurized fluid delivery system and in particular to a fluid flow control device for use in the pressurized fluid delivery system. A separate fluid cylinder block is provided for each motor driven pump plunger so that instead of a single fluid cylinder block accommodating all of the pump plungers, the fluid cylinder blocks are made separately and individually for each pump plunger in the present invention. A novel fluid control valve forms a part of each of the fluid cylinder blocks which has less friction than conventional guides, less overall restriction to fluid flow through the valve, and requires less suction feed pressure to operate.

BACKGROUND OF THE INVENTION

The present invention relates to a pressurized fluid delivery system including a high pressure fluid reciprocating pump and fluid flow control devices in a fluid cylinder block to control the fluid inlets and outlets from the cylinder block. Reciprocating pumps are typically used in high pressure fluid delivery systems to create a high pressure fluid jet such as water to be used for cleaning, for example. Reciprocating pumps of this type generally include a plurality of plungers and cylinders and develop pressures in excess of 10,000 psi thereby subjecting their parts to significant stresses and fatigue failure due to stress fluctuations. Accordingly, because of the severe service environment of high pressure pumps of this type, maintenance may be frequently required particularly to the fluid cylinder block forming the pressure end of the pump. Such systems, as disclosed in commonly assigned U.S. Pat. No. 4,432,386, tend to minimize stress concentration points along with ease of maintenance and durability of construction and are all exceedingly important in determining the overall service performance of high pressure pumps. With all such high pressure pumps, a considerable amount of input energy is required and it is therefore highly desirable to also increase the efficiency of the pump as well as its ease of maintenance. In addition, the single fluid cylinder blocks of the present invention are formed of stainless steel and are very expensive. If a mistake occurs during machining, the entire block must be discarded. In addition, the prior art valve members have vanes extending radially therefrom and therefore have substantial friction because of the large contact area with the fluid cylinder block. Further, these devices must be used at high pressures because of the suction feed pressure required to open and close the valves. Thus, they are not able to be used with low pressure fluid systems.

The present invention overcomes the disadvantages of the prior art by providing a pressurized fluid delivery system in which the pump plungers each have an individual fluid cylinder block attached thereto. Thus, there are three or more smaller pieces necessary for the system to function rather than one large fluid cylinder block. In the construction of these fluid cylinder blocks, if an error is made, only the small block on which the error is made is discarded. Further, because there are three or more individual fluid cylinder blocks instead of one large one, they are sufficiently light that one person can lift each one.

In addition, a fluid flow control valve is placed in the inlet orifice of each of the fluid cylinder blocks and a control valve assembly is placed in the outlet orifice of each fluid cylinder block. These novel control valves are formed such that they have less restriction to fluid flow than in the conventional configurations, have less friction with the guide in which they operate and require less suction feed pressure than is normally required. Each valve has a valve body having at least one fluid path extending therethrough and having a fluid outlet orifice and at least one fluid inlet orifice. A valve member has a piston on one end for blocking the fluid outlet orifice in a first position and opening the fluid outlet orifice in a second position. A stem forms the other end of the valve member and is slidably mounted in an orifice in the valve body with the stem extending beyond the valve body on the inlet side. A shoulder is formed on the outer end of the valve stem and a seat is formed in the valve body inlet side opposite the shoulder. A biasing device such as a spring is mounted between the stem shoulder and the valve body seat to resiliently urge the valve member piston in the first position to block the fluid outlet orifice and prevent the fluid flow through the valve body.

The fluid flow control device is used in a pressurized fluid delivery system wherein a plunger assembly has at least one reciprocating plunger with a power unit for driving the plunger with reciprocating motion. A fluid cylinder block is provided for each reciprocating plunger and individually associated therewith in fluid-tight relationship. The fluid cylinder block has a cavity for receiving one of the plungers so as to create a suction when the plunger moves in one direction and to create a pressure when the plunger moves in the other direction. A fluid inlet manifold and a fluid outlet manifold are individually and operatively coupled to the cavity in each fluid cylinder block to admit fluid to and receive fluid from the cavity in response to the reciprocating motion of the plunger. A first fluid control valve is placed in the fluid inlet manifold to allow fluid into the cavity only when the plunger creates suction. A second fluid control valve in the fluid outlet manifold allows fluid to escape from the cavity only when the plunger creates a pressure in the cavity.

Thus, it is an aspect of the present invention to provide an improved fluid flow control device for use in a fluid control structure.

It is another aspect of the invention to provide a valve body for use with a valve member including a piston and a stem in a fluid flow control device.

Finally, it is an important aspect of the present invention to provide a pressurized fluid delivery system that includes a fluid flow control device to admit the fluid to and receive the fluid from the cavity in response to reciprocating motion of a plunger.

SUMMARY OF THE INVENTION

Thus, the present invention relates to a fluid flow control device for use in a fluid control structure comprising a valve body having at least one fluid path extending therethrough and having a fluid outlet orifice and at least one fluid inlet orifice, a valve member having a piston on one end for blocking the fluid outlet orifice in a first position and opening the fluid outlet orifice in a second position, a stem forming the other end of the valve member and slidably mounted in an orifice in the valve body, the stem extending beyond the valve body on the inlet orifice side, a shoulder on the outer end of the valve stem, a seat in the valve body inlet orifice side opposite the shoulder, and biasing means mounted between the stem shoulder and the valve body seat for resiliently urging the valve member piston in the first position to block the fluid outlet orifice and prevent fluid flow through the valve body.

The invention also relates to a valve body for use with a valve member having a piston and a stem in a fluid flow control device comprising a top wall and a bottom wall on the valve body, a plurality of fluid inlet orifices extending partially into the valve body from the top wall, a single fluid outlet orifice extending partially into the valve body from the bottom wall and being larger than any one of the plurality of fluid inlet orifices, the single orifice intersecting each of the plurality of fluid inlet orifices to form a fluid flow path through the valve body, an orifice in the valve body axially aligned and concentric with the single fluid outlet orifice for slidably receiving the valve member stem, and a seat in the valve body top wall surrounding the axially aligned orifice such that a resilient biasing means placed in the seat surrounds the valve member stem and urges the valve member piston in a direction such that the valve member piston closes the single fluid outlet orifice.

The invention also relates to a pressurized fluid delivery system comprising a plunger assembly having at least one reciprocating plunger, a power unit for driving the at least one plunger with reciprocating motion, a fluid cylinder block for each reciprocating plunger and individually associated therewith in fluid-tight relationship and having a cavity for receiving one of the plungers so as to create a suction when the plunger moves in one direction and to create pressure when the plunger moves in the opposite direction, a fluid inlet manifold and a fluid outlet manifold individually and operatively coupled to the cavity in each fluid cylinder block for admitting fluid to and receiving fluid from the cavity in response to the reciprocating motion of the plunger, a first fluid control valve in the fluid inlet manifold for allowing fluid into the cavity only when the plunger creates a suction, and a second fluid control valve in the fluid outlet manifold for allowing fluid to escape from the cavity only when the plunger creates a pressure.

BRIEF DESCRIPTION OF THE DRAWINGS

These and other objects of the present invention will be more fully disclosed in conjunction with the following detailed description and the drawings in which like numbers represent like elements and in which.

DETAILED DESCRIPTION OF THE DRAWINGS

Figure 1:
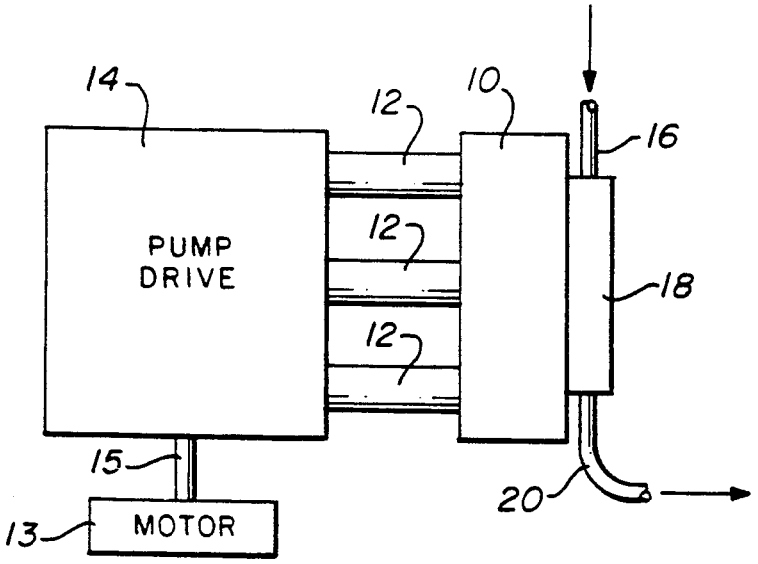
FIG. 1 PRIOR ART
FIG. 1 is a diagrammatic representation of a prior art pressurized fluid delivery system.

As can be seen in FIG. 1, a fluid cylinder block 10 is coupled by in-line valve and pump cylinders 12 to a pump drive 14. The pump drive 14 is driven by a motor 13 through coupling 15 in any well-known manner. Inlet fluid in inlet 16 passes into a manifold 18 in common to all of the individual valve assemblies (not shown) for admitting fluid to the cylinder block 10. As each of the plungers in the pump cylinders 12 moves in a reciprocating fashion, fluid is accepted from the manifold 18 and discharged through fluid outlet 20 under pressure. The fluid cylinder block 10 of FIG. 1 is made of stainless steel, an expensive metal, and is very large and heavy. It is approximately 22 inches long by 12 inches wide by 7 inches deep. During the machining of the fluid cylinder block 10, if a mistake is made in the machining, the entire block 10 has to be discarded and a new block properly machined.

Figure 2:
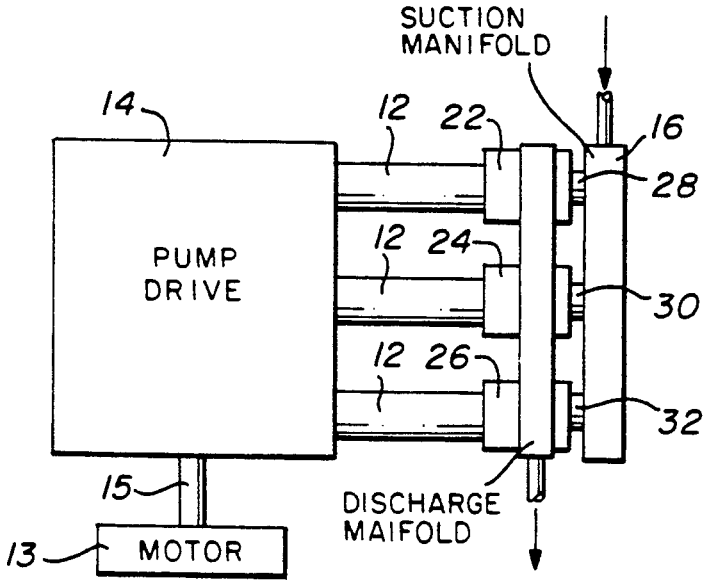
FIG. 2 is a schematic representation of the pressurized fluid delivery system of the present invention.

In the novel system illustrated in FIG. 2 of the present invention, three separate fluid cylinder blocks 22, 24 and 26 are utilized, each of the blocks being individually coupled to an in-line valve and pump cylinder 12. A fluid inlet suction manifold 16 distributes fluid separately to inlet manifolds 28, 30 and 32, each of which is associated with a corresponding one of the fluid cylinder blocks 22, 24 and 26. In like manner, an outlet manifold 34 (shown in FIG. 3) is also individually associated with a corresponding one of the fluid cylinder blocks 22, 24 and 26 and has a common fluid discharge manifold 20 coupled thereto. Each of the fluid cylinder blocks 22, 24 and 26 is approximately 7½ inches long, 4 inches wide, and 6 inches deep. The total volume of the three blocks 22, 24 and 26 is approximately 540 cubic inches, while the volume of the block 10 in FIG. 1 is 1848 cubic inches. Thus, the three individual blocks in combination weigh one-third of the cylinder block 10 in FIG. 1. Further, the blocks 22, 24 and 26 are identical in construction. In the event a mistake in machining is made, the block that has to be discarded contains one-tenth of the expensive stainless steel metal than is in the block 10 in FIG. 1.

Figure 3:
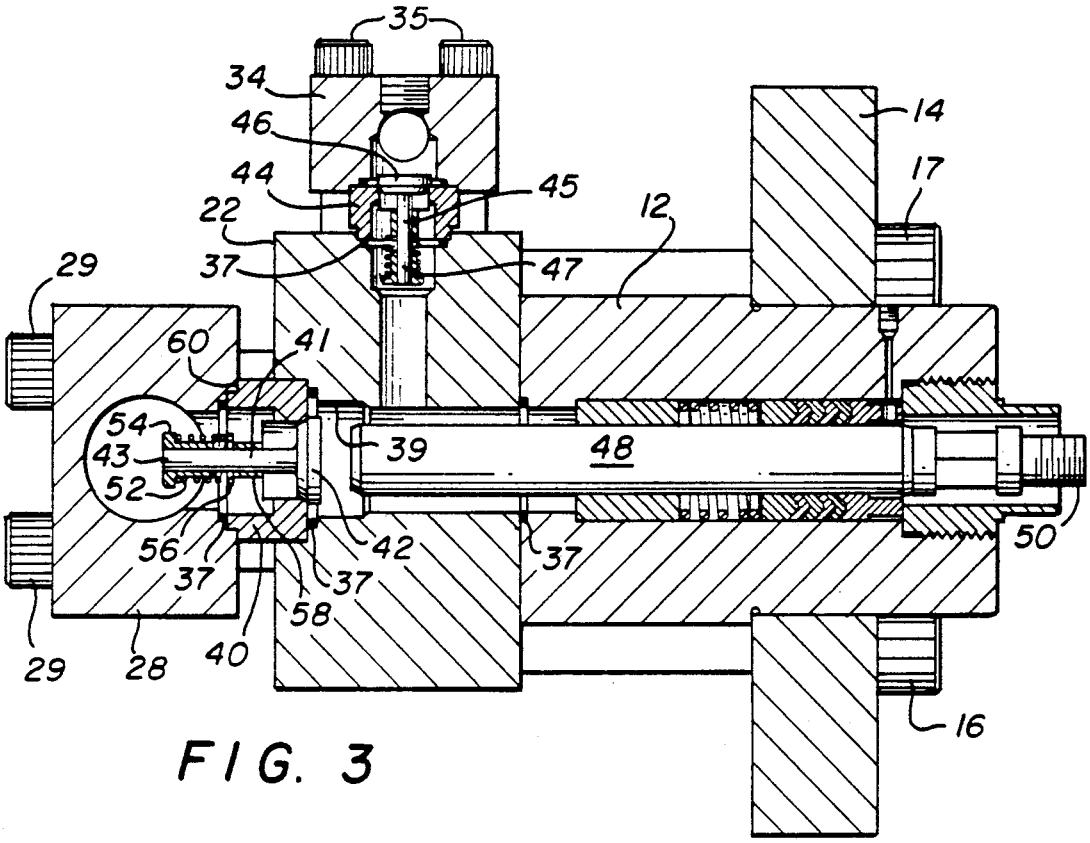
FIG. 3 is a cross-sectional view of the novel fluid cylinder block and attached inlet and outlet manifolds.

The details of one of the novel fluid cylinder blocks 22 in FIG. 2 are illustrated in cross section in FIG. 3. As can be seen in FIG. 3, fluid cylinder block 22 is coupled to the in-line valve pump cylinder 12 and pump drive 14 by means of bolts 16 and 17. A cavity 39 is formed in the cylinder block 22 and a plunger 48 having an end 50 being driven by the pump drive unit 14 extends into cavity 39. A fluid inlet manifold 28 is coupled to cylinder block 22 through an inlet valve body 40 by means of bolts 29. The valve body 40 and the respective valve seats in the cylinder block 2 and the fluid inlet manifold 28 do not have to have precise tolerances because of the use of seals 37.

Figure 4:
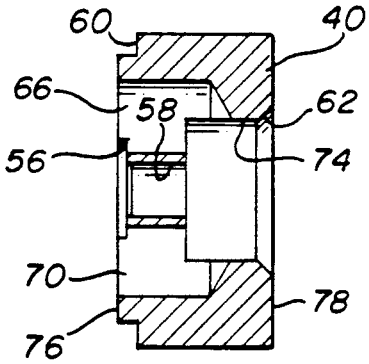
FIG. 4 is a cross-sectional diagram of the valve body itself.
Figure 5:
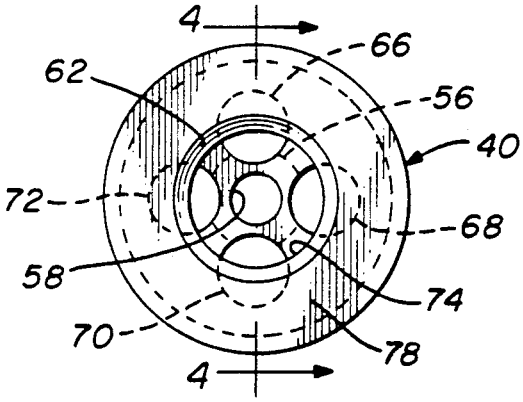
FIG. 5 is a bottom view of the valve body in FIG. 4.
Figure 6:
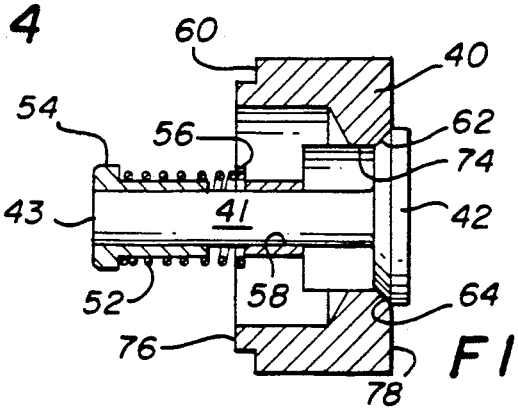
FIG. 6 is a cross-sectional view of the valve body with the valve member operatively installed therein.

The valve body 40 will be illustrated in detail in FIGS. 4, 5 and 6, but as shown in FIG. 3, the body 40 includes a valve member 41 having a piston end 42 and a stem 43. The valve member 41 is slidably mounted in an orifice 58 in the valve body 40. The stem 43 has shoulders 54 rigidly attached thereto in any well-known means as by press fit, for example. A resilient spring member 52 is placed around the valve member 41 between shoulders 54 and a spring seat 56 on the valve body 40. The resilient spring member 52 tends to hold the piston 42 of valve member 41 in a closed relationship to prevent fluid from passing therethrough. When plunger 48 is withdrawn from cavity 39 by the pump drive 14 attached to the end 50 of plunger 48, the suction created in cavity 39 overcomes the pressure of spring 52 to unseat piston 42, thus allowing fluid in the inlet manifold 28 to enter cavity 39. When the plunger 48 stops its withdrawal movement, the suction ceases and piston 42 is returned to its closed position by the force of spring 52. As the plunger 48 comes forward, the fluid that has been taken into cavity 39 and cannot escape through valve 40 enters valve body 44 and forces the piston 46 inwardly against the spring member around the valve stem 47, thus forcing piston 46 outwardly from its seat in valve body 44 and allowing the fluid in cavity 39 to escape into the discharge manifold 34. The valve body 44 may be of different size than valve body 40 or the same size. However, the construction is identical so it will not be discussed in any further detail.

It will be noted in FIG. 3 that the inlet manifold 28 is attached to the fluid cylinder block 22 by bolts 29 while the outlet fluid discharge manifold 34 is attached to the fluid cylinder block 22 by means of bolts 35. Clearly, these fluid cylinder blocks can be easily removed and, because of the use of seals 37, close tolerances are not required. Thus, while the inlet manifold 28 and the discharge manifold 34 are made of expensive stainless steel, they are less expensive than the conventional construction because they can be made as smaller units. Further, they can be used with a pressure up to 15,000 psi, but the design as illustrated in FIG. 3 is also especially good for high volume low pressure pumps. Thus, the construction illustrated in FIG. 3 may cover pumps for a large range of pressures. The fluid manifold block 22 is also made of stainless steel, but, as indicated earlier, it is a tenth of the size of the conventional block 10 illustrated in FIG. 1.

Thus, FIG. 3 discloses a pressurized fluid delivery system comprising a plunger assembly 12 having at least one reciprocating plunger 48 coupled to a power unit 14 for driving the plunger 48 with reciprocating motion. A fluid cylinder block 22 is provided for each reciprocating plunger 48 and is individually associated therewith in fluid-tight relationship by means of seals 37. A cavity 39 receives one of the plungers 48 so as to create a suction when the plunger 48 moves to the right in FIG. 3 and to create a pressure when the plunger 48 moves to the left in FIG. 3. A fluid inlet manifold 28 and a fluid outlet manifold 34 are individually and operatively coupled to the cavity 39 in each fluid cylinder block 22 for respectively admitting fluid to and receiving fluid from the cavity 39 in response to the reciprocating motion of the plunger 48. A first fluid control valve 40 is mounted between the fluid inlet manifold 28 and the fluid cylinder block 22 for allowing fluid into the cavity 39 only when the plunger 48 creates a suction and a second fluid control valve 44 is mounted between the fluid outlet manifold 34 and the fluid cylinder block 22 for allowing fluid to escape from the cavity 39 only when the plunger 48 creates a pressure. Thus, the novel system in FIG. 3 includes the fluid cylinder block 22, the inlet manifold 28, and the outlet manifold 34 with the valves 40 and 44 coupling the inlet and outlet manifolds, respectively, to the fluid cylinder block. All are individually machined parts. Thus, the parts are smaller, lighter and less expensive than the fluid cylinder block 10 of the prior art as illustrated in FIG. 1. Further, because the stainless steel material from which these parts are made is so expensive, if any one of the parts is improperly machined, only that part has to be discarded instead of the entire block 10 shown in the FIG. 1 representation of the prior art. Further, the valve bodies 40 and 44 can be made in various sizes and thus can be used with a wide variety of pumps.

In operation, the device in FIG. 3 allows fluid to enter the cavity 39 from the fluid inlet manifold 28 as plunger 48 moves to the right. The suction causes the piston 42 to be pulled inwardly against spring 52, thus opening the valve body 40 and allowing fluid to enter orifices 66, 68, 70 and 72 (shown in FIG. 5) and pass through orifice 74 into cavity 39. At the end of the stroke of plunger 48, the spring tension caused by compressed spring 52 returns the piston 50 to the closed position, thus placed in the seat surrounding the valve stem 43 and urges the valve member piston 42 in a direction such that the piston 42 closes the single fluid outlet orifice 74. The valve body 40 in the preferred embodiment is cylindrical in shape with the diameter of the top wall 76 being less than the diameter of the bottom wall 78 to ensure that the valve body 40 is properly installed in the fluid cylinder block 22 shown in FIG. 3. Thus, with either the top wall 76 or the bottom wall 78 having a different diameter than the other, and with corresponding shoulders machined in either the inlet manifold 28, the outlet manifold 34 or the fluid cylinder block 22, the valves 40 and 44 in FIG. 3 can be installed in only one direction and cannot be improperly installed. In the preferred embodiment, the plurality of fluid inlet orifices 66, 68, 70 and 72 are cylindrical orifices equally spaced about the axially aligned valve stem orifice 58. Also in the preferred embodiment, the single fluid outlet orifice 74 is a cylindrical orifice in concentric axial alignment with the longitudinal axis of the cylindrical shaped valve body 40. As can be seen in FIGS. 4, 5 and 6, the cylindrical orifice 74 has a sloped shoulder 62 which matches and mates with the sloped shoulder 64 of the piston 42, thus providing a seal when the valve 42 is in the closed position.

The fluid flow control device 40 for use in the fluid control structure of FIG. 3 is shown in its entirety in FIG. 6. The valve body 40 has the fluid path extending therethrough with the fluid outlet orifice 74 and at least one fluid inlet orifice 66, preventing the fluid in cavity 39 from escaping. When the plunger 48 moves to the left, increasing the pressure in cavity 39, piston 42 is held firmly in its position sealing valve body 40. However, valve body 44 allows the fluid to pass through its orifices 66, 68, 70 and 72 against the piston head 46, thus forcing it against spring 52 and opening the valve body 44 to allow the fluid to escape into the outlet or discharge manifold 34. When the pressure is relieved at the end of the stroke of plunger 48, spring 52 returns piston 46 to the closed position and the cycle can be repeated.

Figure 7:
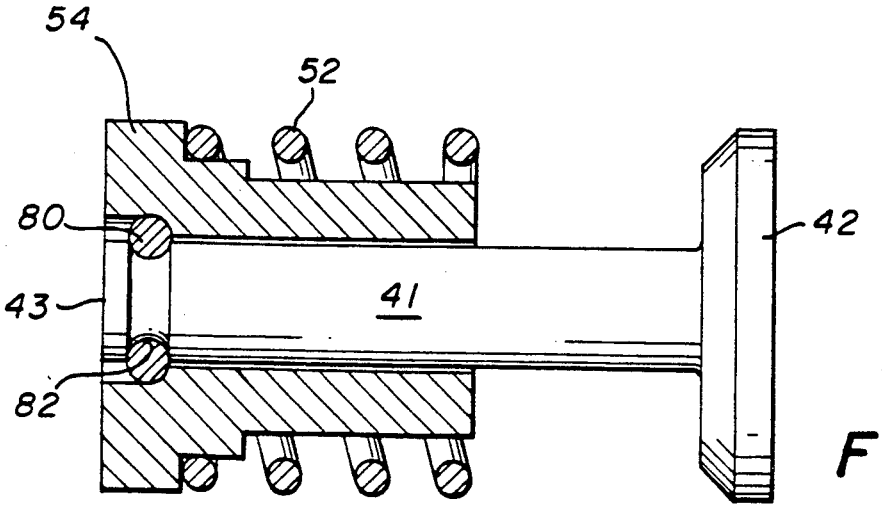
FIG. 7 is a cross-sectional view of an alternate means for providing a shoulder on the outer end of the valve stem of the valve member.

A novel valve body 40 is shown in cross section in FIG. 4 and in a bottom view in FIG. 5. As can be seen in those figures, the valve body 40 includes a top wall 76 and bottom wall 78. A plurality of fluid inlet orifices 66, 68, 70 and 72 extend partially into the valve body 40 from the top wall 76. A single fluid outlet orifice 74 extends partially into the valve body 40 from the bottom wall 78 and has a larger diameter than any one of the plurality of fluid inlet orifices 66, 68, 70 and 72. The single orifice 74 intersects each of the plurality of fluid inlet orifices 66, 68, 70 and 72 to form a fluid flow path through the valve body 40. An orifice 58 is formed in the valve body that is axially aligned and concentric with the single fluid outlet orifice 74 for slidably receiving a valve member stem 43, shown in FIG. 6, and a seat 56 is formed in the top wall 76 of the valve body 40 and surrounds the axially aligned orifice 58 such that a resilient biasing means, such as spring 52 shown in FIG. 6, may be 68, 70 or 72. The valve member 41 has a piston head 42 on one end for blocking the fluid outlet orifice 74 in a first position and opening the fluid outlet orifice 74 in a second position. A stem 43 forms the other end of the valve member 41 and is slidably mounted in the orifice 58 in the valve body 40. The stem 43 extends beyond the valve body 40 on the inlet side as shown. A shoulder 54 is formed on the outer end of the valve stem and may in fact be press fit on the valve member 41 or attached to the valve member 41 in any other well-known manner such as shown in FIG. 7 in which shoulder 54 is forced against retaining ring 80 in groove 82 of the stem 43 by spring 52. By removing the ring 80, the shoulder 54 and spring 52 may be removed. The seat 56 in the valve body 40 on the inlet side opposite the shoulder 54 allows the spring biasing means 52 to be mounted between the stem shoulder 54 and the valve body seat 56 for resiliently urging the valve member piston 42 in a first position to block the fluid outlet orifice 74 and prevent fluid flow through the valve body. The valve body 40 includes the top wall 76 and bottom wall 78 with a plurality of the fluid inlet orifices 66, 68, 70 and 72 extending partially into the valve body 40 from the top wall 76. The single orifice 74 serves as the fluid outlet and extends partially into the valve body 40 from the bottom wall 78. The single outlet orifice 74, as can be seen, is larger in diameter than any one of the plurality of inlet orifices 66, 68, 70 and 72. This can be best seen in FIG. 5. Also, as can be seen best in FIGS. 4 and 6, the single orifice 74 intersects each of the plurality of fluid inlet orifices 66, 68, 70 and 72 to form a fluid path through the valve body 40. The beveled edges 62 on the fluid outlet orifice 74 match the beveled edges 64 on the valve member piston 42 such that when the piston 42 is in the first position, a seal is formed between the piston 42 and the fluid outlet orifice 74 to prevent fluid flow through the valve body.

Thus, there has been disclosed a novel valve body, a fluid flow control device for use in a fluid control structure and a novel pressurized fluid delivery system. The novel valve body is a single one-piece unit valve assembly that can be used for many different types of pumps just by changing the fluid cylinder block. By having a plurality of small input orifices all intersecting a single large output orifice that is controlled by a single piston, the valve body can be made small, light and comparatively inexpensive although made out of an expensive material. The novel fluid flow control device itself includes a valve body having a valve member that is resiliently biased in a first direction to prevent fluid flow through the device. This device has much less friction than conventional valve members because of the smaller area of contact between the piston stem 43 and the orifice 58 in the valve body 40. Because of the larger area of piston 42 than in the conventional devices, less suction feed pressure is required of this valve to maintain comparable volumes and pressures of the prior art valves. When this fluid flow control device is used in conjunction with fluid inlet and outlet manifolds and a single fluid cylinder block for each plunger, the entire assembly becomes much smaller than the prior art devices. For a three-plunger pump, the present system in its entirety weighs less than one-third of the single block comprising the fluid cylinder block of the prior art. In addition, because of the smaller individual units, one person can easily carry them and maintain the units. Further, the expense of manufacturing the devices decreases significantly because of less material being used and because of less waste should a mistake be made in the machining of the device.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A valve body to be used with a valve member having a piston and a stem, the valve body adapted for use in a fluid flow control device and comprising:

a unitary cylindrical body portion;

a top wall and a bottom wall on the valve body portion, a plurality of cylindrical shaped parallel fluid inlet orifices extending only partially into the valve body portion from and substantially perpendicular to the top wall;

a single cylindrical fluid outlet orifice extending only partially into the center of the valve body portion from the bottom wall and being larger than any one of the plurality of fluid inlet orifices, the single orifice only partially intersecting each of the plurality of fluid inlet orifices to form a fluid flow path through the valve body portion;

a valve stem orifice in the valve body portion axially aligned and concentric with the single fluid outlet orifice for slidably receiving the valve member stem; and a seat in the top wall of the valve body portion surrounding the axially aligned orifice such that a resilient biasing means placed in the seat surrounds the valve member stem and urges the valve member piston in a direction such that the valve member piston closes the single fluid output orifice.

2. A valve body as in claim 1 wherein:

the plurality of fluid inlet orifices comprises four cylindrical orifices equally spaced about the axially aligned valve stem orifice; and the single fluid outlet orifice is a cylindrical orifice in concentric axial alignment with the longitudinal axis of the cylindrical shaped valve body.

3. A pressurized fluid delivery system comprising:

a first, second and third fluid cylinder blocks;

a plunger assembly having at least one reciprocating plunger individually associated with each fluid cylinder block in fluid-tight relationship and having a cavity for receiving one of the plungers so as to create a suction when the plunger moves in one direction and to create a pressure when the plunder moves in the opposite direction;

a power unit for driving each of the plungers with reciprocating motion;

a fluid inlet manifold and a fluid outlet manifold individually and operatively coupled to the cavity in each fluid cylinder block for admitting fluid to and receiving fluid from the cavity in response to the reciprocating motion of the plunger;

a first fluid control valve mounted between the fluid inlet manifold and each fluid cylinder block for allowing fluid into the associated cavity only when the plunder creates a suction;

a second fluid control valve mounted between the fluid outlet manifold and each fluid cylinder block for allowing fluid to escape from the cavity only when the plunger creates a pressure;

each of the fluid control valves comprising a unitary cylindrical body portion with atop wall and a bottom wall;

a plurality of cylindrical shaped parallel fluid inlet orifices extending only partially into the valve body portion from and substantially perpendicular to the top wall;

a single cylindrical fluid outlet orifice extending only partially into the center of the valve body portion from the bottom wall and being larger than any one of the plurality of fluid inlet orifices, the single orifice only partially intersecting each of the plurality of fluid inlet orifices to form a fluid flow path through the valve body portion;

a valve stem orifice in the valve body portion axially aligned and concentric with the single fluid outlet orifice for slidably receiving the valve member stem;

a seat in the top wall of the valve body portion surrounding the axially aligned orifice such that a resilient biasing means placed in the seat surrounds the valve member stem and urges the valve member piston in a direction such that the valve member piston closes the single fluid output orifice;

the periphery of the top wall having a first configuration;

the periphery of the bottom wall having a second configuration such that each fluid flow control valve can be installed in the fluid manifolds for fluid flow in only one direction;

a circumferential groove on the outer end of the valve stem;

a retaining ring in the groove;

a shoulder on the outer end of the valve stem;

an outer edge and an inner edge on the shoulder; and biasing means engaging the outer edge of the shoulder and the valve body seat to force the inner edge of the shoulder against the retaining ring to urge the valve member piston in the first direction.

* * * * *

UNITED STATES PATENT AND TRADEMARK OFFICE

CERTIFICATE OF CORRECTION

PATENT NO. : 5,171,136

DATED : December 15, 1992

INVENTOR(S) : AMOS PACHT

It is certified that error appears in the above-identified patent and that said Letters Patent is hereby corrected as shown below:

Column 6, line 15, after "position, thus" and continuing through "72." in column 7, line 5, delete the entire text and insert in place thereof:

--preventing the fluid in cavity 39 from escaping. When the plunger 48 moves to the left, increasing the pressure in cavity 39, piston 42 is held firmly in its position sealing valve body 40. However, valve body 44 allows the fluid to pass through its orifices 66, 68, 70 and 72 against the piston head 46, thus forcing it against spring 52 and opening the valve body 44 to allow the fluid to escape into the outlet or discharge manifold 34. When the pressure is relieved at the end of the stroke of plunger 48, spring 52 returns piston 46 to the closed position and the cycle can be repeated.

A novel valve body 40 is shown in cross section in FIG. 4 and in a bottom view in FIG. 5. As can be seen in those figures, the valve body 40 includes a top wall 76 and bottom wall 78. A plurality of fluid inlet orifices 66, 68, 70 and 72 extend partially into the valve body 40 from the top wall 76. A single fluid outlet orifice 74 extends partially into the valve body 40 from the bottom wall 78 and has a larger diameter than any one of the plurality of fluid inlet orifices 66, 68, 70 and 72. The single

UNITED STATES PATENT AND TRADEMARK OFFICE

CERTIFICATE OF CORRECTION

PATENT NO. : 5,171,136

DATED : December 15, 1992

INVENTOR(S) : AMOS PACHT

It is certified that error appears in the above-identified patent and that said Letters Patent is hereby corrected as shown below:

orifice 74 intersects each of the plurality of fluid inlet orifices 66, 68, 70 and 72 to form a fluid flow path through the valve body 40. An orifice 58 is formed in the valve body that is axially aligned and concentric with the single fluid outlet orifice 74 for slidably receiving a valve member stem 43, shown in FIG. 6, and a seat 56 is formed in the top wall 76 of the valve body 40 and surrounds the axially aligned orifice 58 such that a resilient biasing means, such as spring 52 shown in FIG. 6, may be placed in the seat surrounding the valve stem 43 and urges the valve member piston 42 in a direction such that the piston 42 closes the single fluid outlet orifice 74. The valve body 40 in the preferred embodiment is cylindrical in shape with the diameter of the top wall 76 being less than the diameter of the bottom wall 78 to ensure that the valve body 40 is properly installed in the fluid cylinder block 22 shown in FIG. 3. Thus, with either the top wall 76 or the bottom wall 78 having a different diameter than the other, and with corresponding shoulders machined in either the inlet manifold 28, the outlet manifold 34 or the fluid cylinder block 22, the valves 40 and 44 in FIG. 3 can be installed in only one direction and cannot be improperly installed. In the preferred embodiment, the plurality of fluid inlet orifices 66, 68, 70 and 72 are cylindrical orifices equally spaced about the axially aligned valve stem orifice 58.

UNITED STATES PATENT AND TRADEMARK OFFICE

CERTIFICATE OF CORRECTION

PATENT NO. : 5,171,136

DATED : December 15, 1992

INVENTOR(S) : AMOS PACHT

It is certified that error appears in the above-identified patent and that said Letters Patent is hereby corrected as shown below:

Also in the preferred embodiment, the single fluid outlet orifice 74 is a cylindrical orifice in concentric axial alignment with the longitudinal axis of the cylindrical shaped valve body 40. As can be seen in FIGS. 4, 5 and 6, the cylindrical orifice 74 has a sloped shoulder 62 which matches and mates with the sloped shoulder 64 of the piston 42, thus providing a seal when the valve 42 is in the closed position.

The fluid flow control device 40 for use in the fluid control structure of FIG. 3 is shown in its entirety in FIG. 6. The valve body 40 has the fluid path extending therethrough with the fluid outlet orifice 74 and at least one fluid inlet orifice 66, 68, 70 or 72.--

IN THE CLAIMS:

Claim 3, column 8, line 56, delete "plunder" and insert in place thereof --plunger--.

Claim 3, column 9, line 6, delete "atop" and insert in place thereof --a top--.

Signed and Sealed this

Sixteenth Day of November, 1993

Bruce Lehman

*Attest:*

BRUCE LEHMAN

*Attesting Officer*

*Commissioner of Patents and Trademarks*